United States Patent [19]

Hunt

[11] 4,276,674

[45] Jul. 7, 1981

[54] ROTARY BROOM FOR SWEEPER

[75] Inventor: Frederick B. Hunt, Wauwatosa, Wis.

[73] Assignee: Milwaukee Dustless Brush Co., Milwaukee, Wis.

[21] Appl. No.: 118,501

[22] Filed: Feb. 4, 1980

[51] Int. Cl.[3] ..... A46B 7/10

[52] U.S. Cl. ..... 15/182

[58] Field of Search ..... 15/179, 181, 182, 183, 15/198, 199, 200, 82–86

[56] References Cited

U.S. PATENT DOCUMENTS

| | | | |
|---|---|---|---|
| 3,343,884 | 9/1967 | Hunt | 15/182 X |
| 3,750,225 | 8/1973 | Gould et al. | 15/182 |
| 3,862,462 | 1/1975 | Reiter | 15/182 |

*Primary Examiner*—Peter Feldman

*Attorney, Agent, or Firm*—Andrus, Sceales, Starke & Sawall

[57] ABSTRACT

A rotary broom for street sweepers and the like includes a central core. The spaced turns of a sweeping brush extend around the core. A spacer, such as a tape running parallel to the axis of the core, interconnects the turns of the brush for limiting longitudinal movement of the turns relative to each other to provide a desired spacing between the turns.

16 Claims, 9 Drawing Figures

ROTARY BROOM FOR SWEEPER

The present invention relates to rotary brushing implements.

Numerous types of apparatus employ rotary sweeping or brushing implements. Typical of such apparatus are street cleaners in which the rotating implement is used to pick up trash off the street and place it on a conveyor or in a bin for disposal. In the street cleaner field, the implements are often called "brooms" and the term is so used herein.

The bristle or brush portion of a typical rotary broom in use today is initially formed as a strip having a channel in which the bristles are seated and which is crimped to retain the bristles. The brush portion is then placed on the core or mandrel to form the rotary broom.

In one type of rotary broom, the brush portion is helically wound about the core. A recent development in this kind of broom utilizes a so-called "trackless core". In such a boom, the heretofore commonly used retaining track or groove in the core for the helically wound strip of bristles is omitted. See U.S. Pat. No. 3,750,225 to Gould. The ends of the strip are retained on the core and the helical turns, intermediate the ends, are free to move or "float" with respect to the core as the broom is used. The advantages of such a broom include small shipping bulk and economical replacement of the helical strip as contrasted to other types of brooms.

However, with the omission of the track for retaining and positioning the brush on the core, there arises the problem of maintaining a desired spacing among the turns along the core. The desired spacing is usually uniform to provide a broom of generally constant density along its length, although it is sometimes desired to have a greater bristle density in some areas than in others.

Undesired spacing may occur when the broom encounters objects in use which push or pull two adjacent turns apart or together thereby altering their relative position. Sometimes, the brush is distorted as it is removed from the shipping container or as it is placed on the core.

Once a particular undesired spacing of the turns becomes established, it tends to be set in the brush. Each time the broom is used, the same undesired spacing appears in the broom.

In another common type of rotary broom, the turns of the brush are individually formed in the shape of annuli. These annular "wafers" are slid on the core to form the broom. Annular spacers alternate with the wafers in the stack to provide the desired spacing to the turns. However, the need for the spacers and the complexity of assemblying and disassembling this type of broom substantially increase its cost.

It is, therefore, the object of the present invention to provide an improved brush structure for a rotary broom having a means for simply and economically providing and maintaining the desired spacing of the turns of the brush. The establishment and reappearance of undesired spacing irregularities is prevented.

Briefly, the present invention contemplates an improved brush for use in a rotary broom having a central core extendable longitudinally along the axis of rotation of the broom. The sweeping brush has a plurality of turns spaced along the periphery of the core as by helical winding or as annular wafers. The turns of the sweeping brush are free to move longitudinally along the core. A spacing means interconnects the turns of the brush at a discrete circumferential location on the turns for restraining the longitudinal movements of the turns relative to each other for providing a desired longitudinal spacing.

The spacer may comprise a tape, such as nylon tape, running parallel to the axis of the core and fastened to each turn of the brush with the desired spacing between the turns. When the broom is used, the type maintains the desired spacing of the turns. A single tape may be used or two or more tapes circumferentially spaced about the periphery of the core may be used.

The tape may lie beneath the turns along the core and be fastened to the bottom of the channel. Or, the tape may be threaded through the bristles of the brush and fastened to the bristles or the top of the channel. Or, tapes may be provided above and below the channel and fastened together between the turns to establish and maintain the spacing.

The invention may be more fully understood by reference to the following drawings and detailed description.

Figure 1:
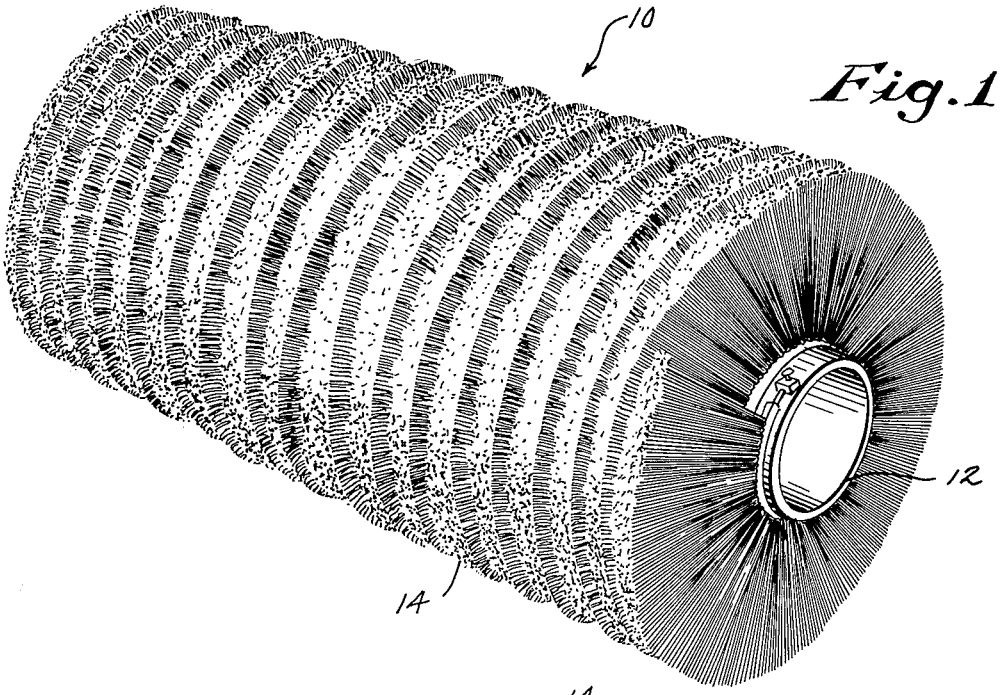
FIG. 1 is a perspective view of a rotary broom having a helically wound brush portion in which the present invention may be incorporated.

FIG. 1 shows a rotary broom 10 including core or mandrel 12 typically having a smooth exterior. Core 12 may be formed of steel, paper, fiber, or plastic tubing having dimensions appropriate for the apparatus, such as a street cleaner, with which the rotary broom is to be used. Strip like brush 14 is helically wound about core 12.

Figure 3:
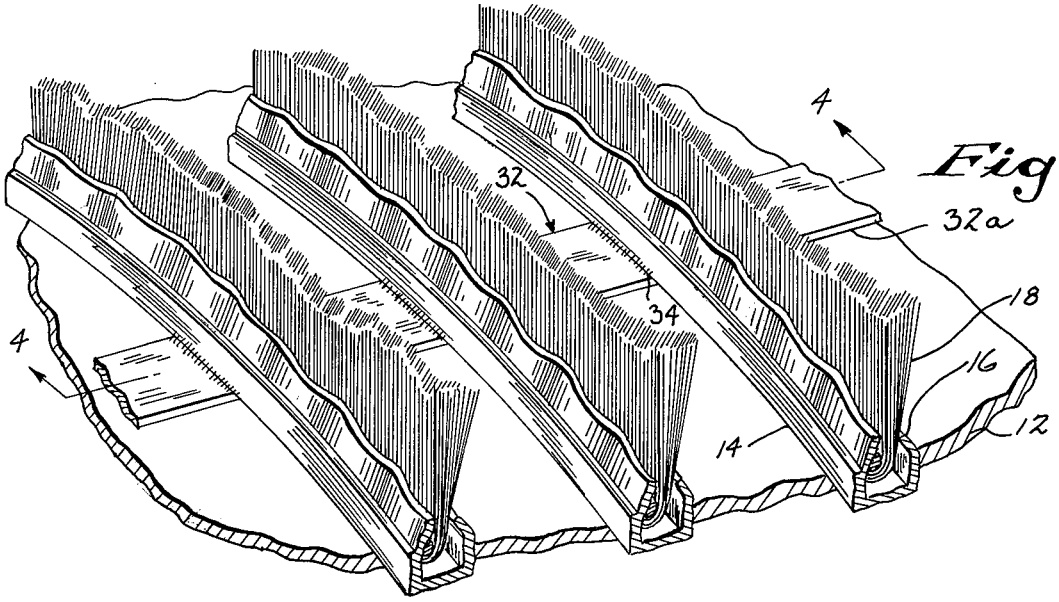
FIG. 3 is a partial perspective view showing one embodiment of the spacer means according to the present invention.
Figure 4:
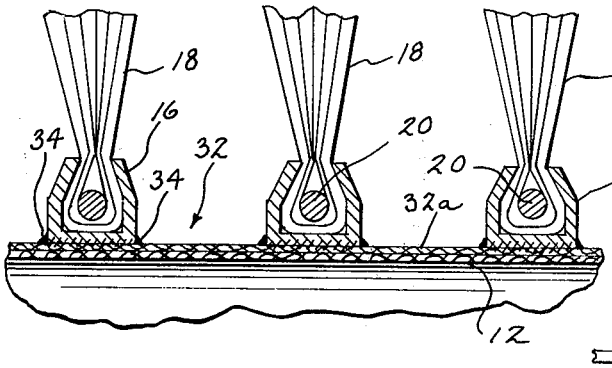
FIG. 4 is a cross-section view taken along the line 4—4 of FIG. 3.

A typical construction for brush 14 is shown in FIGS. 3 and 4. The brush consists of a channel 16 which receives bristles 18. Bristles 18 may be bent around anchor wire 20 lying in channel 16. Channel 16 is crimped at its extremities to maintain bristles in the channel. It will be appreciated that other constructions may be used to produce the strip of bristles which forms brush 14.

Figure 2:
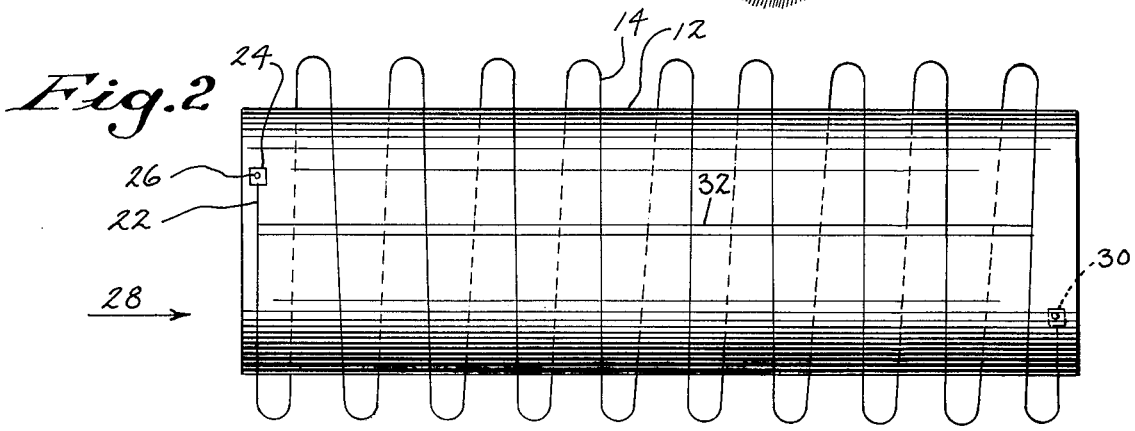
FIG. 2 is a schematic mechanical diagram showing details of the construction of a rotary broom shown in FIG. 1.

The placement of brush 14 on core 12 may be most easily seen with the aid of the schematic diagram of FIG. 2. One end of brush 14 is attached to one end of core 12, as by inserting the former in block 24 containing set screw 26. The helical turns of brush 14 lie freely around core 12 in a given winding direction, for example, the clockwise winding direction when rotary broom 10 is viewed in the direction of arrow 28 in FIG.

2. The other end of brush 14 is retained on core 12 as by inserting it in a device 30, such as a hoop or a slack adjuster as, for example, that shown in the aforesaid Gould patent.

In operation, core 12 is mounted in the street cleaner and rotated about a horizontal axis. With the broom oriented as in FIG. 2, this rotation will be in the counterclockwise direction when rotary broom 10 is viewed in the direction of arrow 28. The rotation of the broom and the friction developed between the rotating broom 10 and the street moves brush 14 on core 12. The friction will tighten the loose turns of helical brush 14 on core 12 by the circumferential movement of the former about the latter. Brush 14 may loosen when broom 10 is lifted off the street.

As noted supra, in the past, when the helix of brush 14 has become distorted or irregular for a variety of reasons, undesired gaps appeared in broom 10 when used, due to the spacing of the turns when brush 14 tightened on core 12. Once the distortion occurred, it tended to become permanent and reoccur each time brush 14 was used.

To prevent this, the present invention employs spacer 32 which interconnects the turns of the brush and limits longitudinal movement of the turns along the core relative to each other for retaining a desired spacing between the turns. Such a spacer is shown is diagrammatically in FIG. 2 and in detail in FIGS. 3 through 7. Spacer 32 may be formed of a tape 32*a* of nylon or other appropriate material and lie beneath the turns of brush 14, along core 12, as shown in FIG. 3. Tape 32*a* is fastened to channel 16 of brush 14 so that a desired spacing, typically uniform, exists between the turns. With the turns so held by tape 32*a*, the distortion heretofore occurring in brush 14, cannot occur.

A signal tape 32 may be used, as shown in the figures, or a plurality of tapes circumferentially spaced about the periphery of core 12 may be utilized.

Spacer 32 may be fastened to channel 16 in a variety of ways, as through the use of the adhesive 34 shown in FIGS. 3 and 4, or a mechanical fastener such as a clip or rivet.

Figure 5:
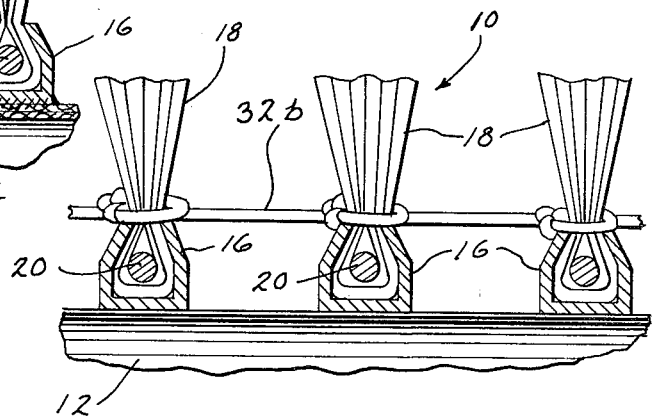
FIG. 5 is a cross-sectional view similar to FIG. 4 showing another embodiment of the present invention.
Figure 6:
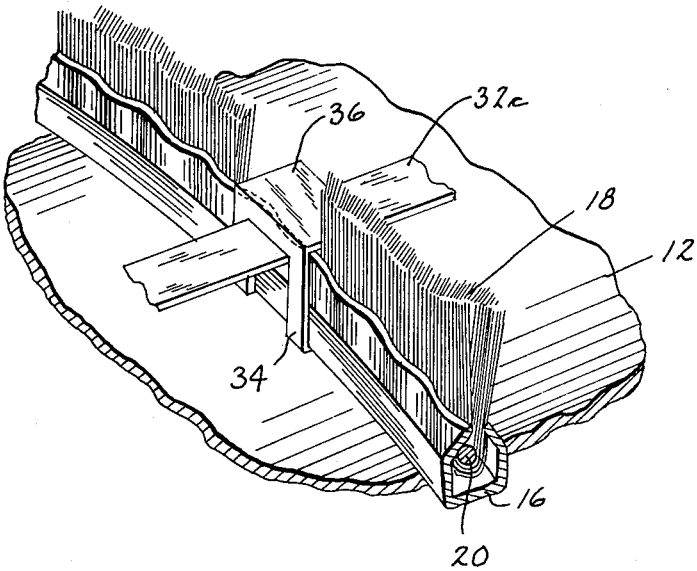
FIG. 6 is a perspective view similar to FIG. 3 showing a further embodiment of the present invention.

FIGS. 5 and 6 show the spacer 32 running over channel 16 rather than under it. In FIG. 5, the spacer may comprise a cord 32*b* tied around groups of bristles 18 in brush 10. Cord 32*b* may be tied around channel 16, if desired. FIG. 6 shows the use of a clip 36 to secure tape 32*c* to brush 12 as by crimping it over the sides of channel 16.

Figure 7:
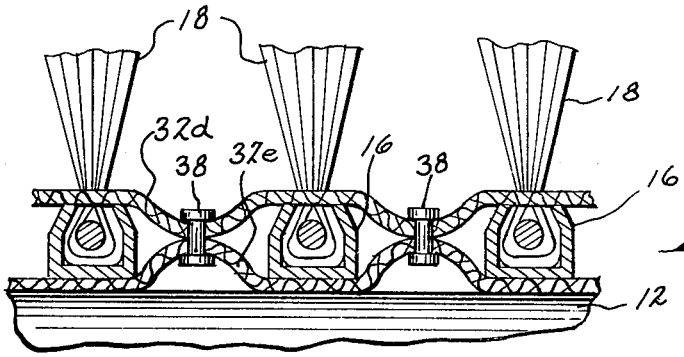
FIG. 7 is a cross-sectional view similar to FIGS. 4 and 5 showing yet another embodiment of the present invention.

FIG. 7 shows the use of a pair of tapes 32*d* and 32*e*, one of which runs under channel 16 and the other of which runs over channel 16. The turns of brush 14 may be retained in the desired position by joining tapes 32*d* 32*e* together between the turns as by sewing, glueing, or heat sealing, or by the use of a fastener, such as a rivet 38, cinch, loop, or the like.

Figure 8:
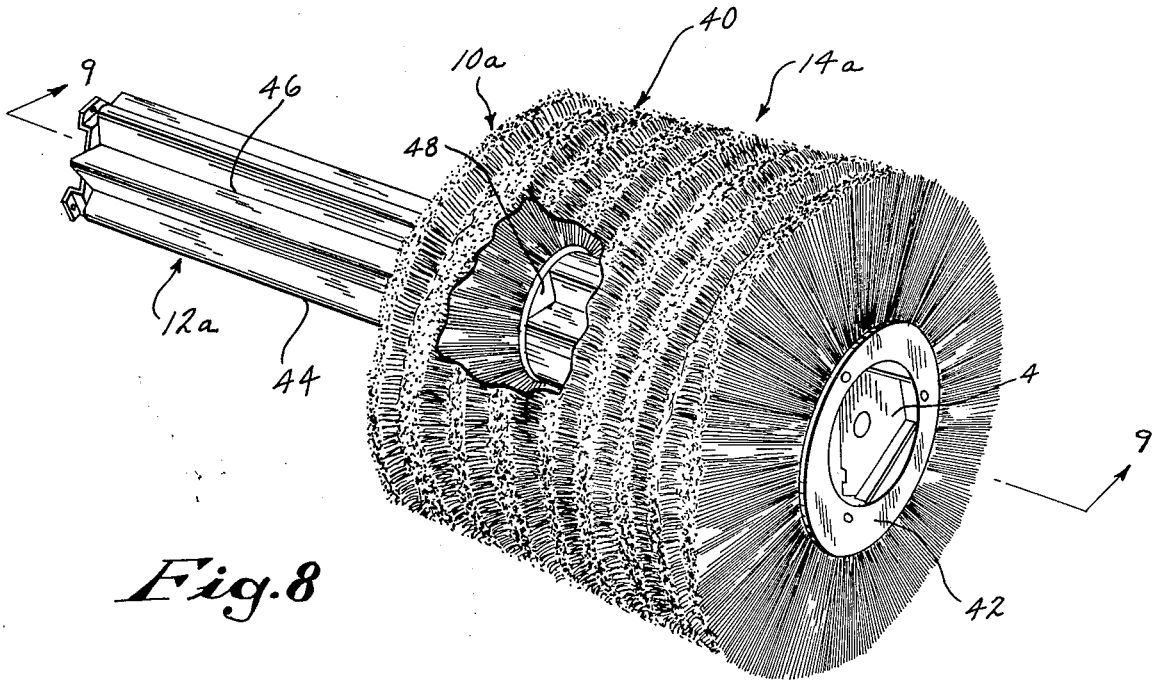
FIG. 8 is a partially cut away perspective view of a rotary broom having a wafered brush portion in which the present invention may be incorporated.

FIG. 8 shows a rotary broom 10*a* in which the brush 14*a* comprises a plurality of annular wafers 40. Wafers 40 are mounted on core 12*a* formed of end plate 42 separated by elongated members 44 having grooves 46. Wafers 40 contain keys 48 which engage grooves 46 to prevent the wafers from rotating on the core.

Figure 9:
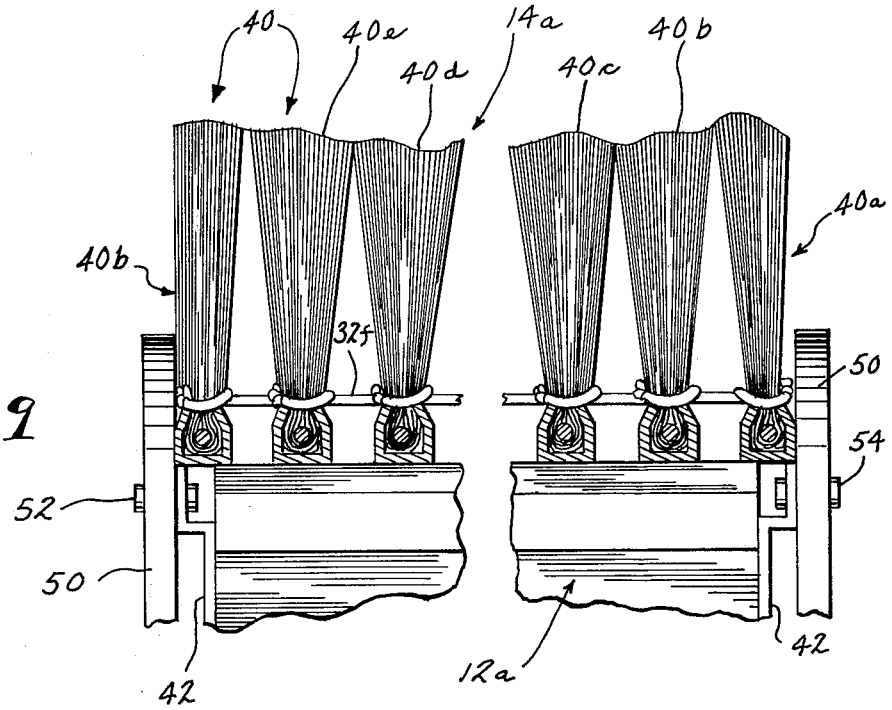
FIG. 9 is a partial cross-sectional view taken along the line 9—9 in FIG. 8.

FIG. 9 shows the details of brush 14*a*, including the manner in which wafers 40 are spacedly positioned along core 12*a* in accordance with the present invention. The outermost wafer 40*a* and 40*b* on each end of core 12*a* is fastened to plate 42, as by discs 50 and bolts 52, 54. The position of intermediate wafers 40*c*, 40*d*, 40*e*, etc. on core 12*a* is established and maintained by spacer 32*f* extending between wafers 40*a* and 40*b* and to which the intermediate wafers are affixed at the desired spaced positions. While FIG. 9 shows a tape or cord 32*f* tied to wafers 40, in a manner similar to that shown in FIG. 5, it will be appreciated that any of the techniques employed in FIGS. 3 through 7 may be used in the embodiment of FIG. 9. Wafers 40 are thus established and maintained in the desired position without the need for the annular spacers formerly required.

Various modes of carrying out the invention are contemplated as being within the scope of the following claims particularly pointing out and distinctly claiming the subject matter which is regarded as the invention.

I claim:

1. An improved brush for use on a rotary broom having a central core extendable longitudinally along the axis of rotation of the broom, said improved brush comprising:

sweeping brush means having turns spacedly positionable along the periphery of the core, the turns of said sweeping brush being free to move at least longitudinally along said core; and spacer means interconnecting adjacent turns of said brush at a discrete circumferential location on said turns for limiting the longitudinal movement of said turns relative to each other for providing a desired longitudinal spacing to said turns along said core.

2. The improved brush according to claim 1 wherein said brush means is helically coiled having an end attached to the core.

3. The improved brush according to claim 1 wherein said brush means comprises a plurality of separate turns positionable on the core.

4. The improved brush according to claim 1, 2, or 3 wherein said spacer means runs between adjacent turns parallel to the axis of said core.

5. The improved brush according to claim 1, 2, or 3 further including a plurality of spacer means positioned at a plurality of discrete circumferential locations about the periphery of said core.

6. The improved brush according to claim 1, 2, or 3 wherein said spacer means provides a uniform longitudinal spacing to said turns.

7. The improved brush according to claims 1, 2, or 3 wherein said spacer means provides a nonuniform longitudinal spacing to said turns.

8. The improved brush according to claims 1, 2, or 3 wherein said spacer means comprises an elongated flexible member interconnecting said turns.

9. The improved brush according to claims 1, 2, or 3 wherein said spacer means is positioned beneath said brush means.

10. The improved brush according to claims 1, 2, or 3 wherein said brush means has a base means securing bristles of said brush and wherein said spacer means is positioned above said base means.

11. The improved brush according to claims 1, 2, or 3 wherein said spacer means is fastened by a mechanical fastener element.

12. The improved brush according to claims 1, 2, or 3 wherein said spacer means is tied to said turns of said brush means.

13. The improved brush according to claims 1, 2, or 3 wherein said spacer means is fastened by adhesive.

14. The improved brush according to claims 1, 2, or 3 wherein said spacer means comprises a pair of spacer elements, one of which runs beneath said base member and the other of which runs above said base member, at least one of said spacer member.

15. The improved brush according to claim 14 wherein said first and second spacer elements are connected intermediate said turns of said brush for joining said spacer means to said turns.

16. The improved brush according to claims 1, 2, or 3 comprising said core in combination with said brush means and spacer means.

* * * * *